US005816153A

United States Patent [19]

Zuber

[11] Patent Number: 5,816,153

[45] Date of Patent: Oct. 6, 1998

[54] PROTECTIVE COVER

[75] Inventor: Mathias Zuber, Helmstadt-Bargen, Germany

[73] Assignee: Heidelberger Druckmaschinen AG, Heidelberg, Germany

[21] Appl. No.: 790,547

[22] Filed: Jan. 30, 1997

[30] Foreign Application Priority Data

Jan. 30, 1996 [DE] Germany ..... 196 03 214.8

[51] Int. Cl.[6] ..... B41F 1/64

[52] U.S. Cl. ..... 101/216; 101/477

[58] Field of Search ..... 101/216, 415.1, 101/477, 212; 400/690–690.4, 692, 693

[56] References Cited

U.S. PATENT DOCUMENTS 4,669,380 6/1987 Seib et al. ..... 101/216
5,613,438 3/1997 Rehberg ..... 101/216
5,649,487 7/1997 Zuber ..... 101/477

FOREIGN PATENT DOCUMENTS 42 24 832 10/1993 Germany .
43 28 053 2/1995 Germany .

*Primary Examiner*—Christopher A. Bennett
*Attorney, Agent, or Firm*—Herbert L. Lerner; Laurence A. Greenberg

[57] ABSTRACT

An arrangement for controlling a pressure medium of an actuator cylinder on a printing press, wherein the actuator cylinder is provided for moving a protective cover into respective opened and closed positions, includes a control circuit for setting different working-pressure ranges for the actuator cylinder.

6 Claims, 1 Drawing Sheet

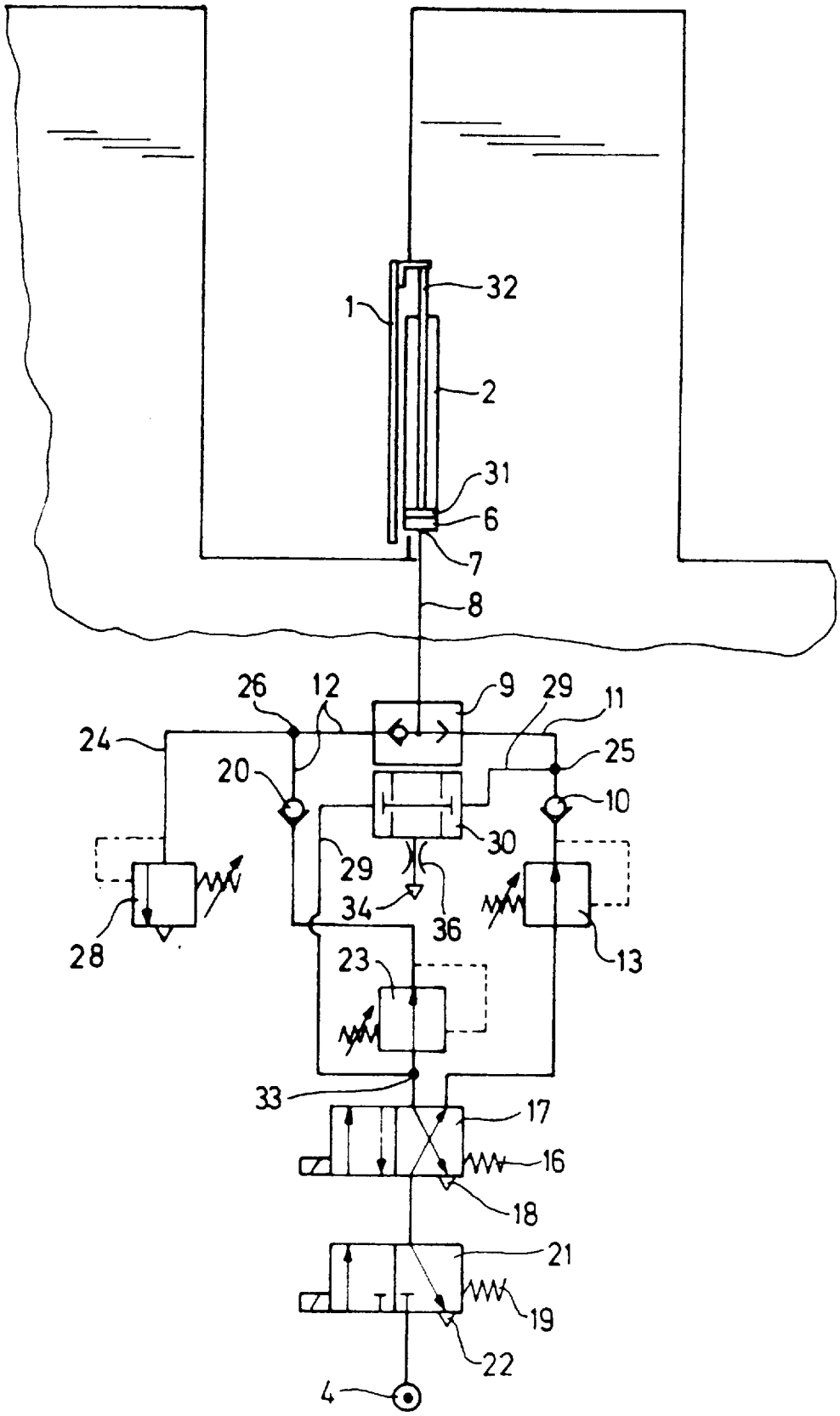
32
1
2
31
6
7
8
26
12
9
29
11
24
25
20
10
30
29
34
36
28
13
23
33
17
16
18
21
19
22
4

PROTECTIVE COVER

BACKGROUND OF THE INVENTION

Field of the Invention

The invention relates to an arrangement for switching or controlling a pressure medium for an actuator cylinder for positioning a protective cover or guard on a printing press.

It has become known heretofore from the published German Patent Document DE 42 24 832 C2 to use a pneumatically acting lifting cylinder for opening and closing a magazine serving as a protective cover.

It is an object of the invention to provide a protective cover with a switching or control arrangement for a pressure medium of an actuator cylinder provided for positioning the protective cover in a printing press.

With the foregoing and other objects in view, there is provided, in accordance with the invention, an arrangement for controlling a pressure medium of an actuator cylinder on a printing press, wherein the actuator cylinder is provided for moving a protective cover into respective opened and closed positions, comprising a control circuit for setting different working-pressure ranges for the actuator cylinder.

In accordance with another feature of the invention, the actuator cylinder is of a single-acting construction.

In accordance with a further feature of the invention, the control circuit includes a working line for lifting the protective cover into the opened position thereof, and a working line for lowering the protective cover into the closed position thereof, and the working-pressure range in the working line for lifting the protective cover is settable in a higher range than the working-pressure range in the working line for lowering the protective cover.

In accordance with an added feature of the invention, the working pressure for lifting the protective cover is settable so that it exceeds the force of the weight of the protective cover to an extent that it is at most equal to a determinable maximum shear force.

In accordance with an additional feature of the invention, the working pressure for lowering the protective cover is settable so that it is less than the force of the weight of the protective cover to an extent that only a maximum determined shear force is effective.

In accordance with yet another feature of the invention, the arrangement includes a pressure-reducing valve built into the working line for lifting the protective cover.

In accordance with yet a further feature of the invention, the arrangement includes a pressure-reducing valve and a parallel-connected pressure-limiting valve built into the working line for lowering the protective cover.

In accordance with a concomitant feature of the invention, the arrangement includes an additional working line having a double-pressure valve connected therein, the additional working line connecting the working line for lifting the protective cover to the working line for lowering the protective cover.

The invention is thus based on the advantage that a single-acting actuator cylinder can be used.

Through the use of pressure-limiting valves, in particular, preferably built into both a lifting line and also a lowering line, it is possible to adjust a shear force, which occurs when the protective cover is moved, so that injury to operating personnel can be prevented.

In order to compensate for the force of gravity or weight of the protective cover during lifting, it is possible for the pressure in the protective-cover lifting line to be set in a higher pressure range than in the protective-cover lowering line.

In order also to ensure maximum safety in the event of a sudden decrease in power from the pressure-generating source, a non-return or check valve is built into both the lifting line and the lowering line.

Other features which are considered as characteristic for the invention are set forth in the appended claims.

Although the invention is illustrated and described herein as embodied in protective covers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, wherein:

BRIEF DESCRIPTION OF THE DRAWING

The single figure shows, in a schematic and diagrammatic view, an embodiment of a protective cover having a switching or control arrangement for switching or controlling a pressure medium for an actuator cylinder for positioning the protective cover in a printing press in accordance with the invention.

DESCRIPTION OF THE PREFERRED EMBODIMENTS

Referring now to the single figure of the drawing, there is shown therein a protective cover 1 for a printing press which, in order to be positioned in an upper "open position" and a lower "closed position", is provided with two respectively laterally disposed single-acting cylinders 2, only one of which is illustrated, wherein a return stroke is initiated or introduced by the force of gravity of the protective cover 1. The stroke of the cylinders 2 is produced by applying a working medium, such as hydraulic fluid, preferably compressed air, from a pressure-generating source 4, to the cylinders 2.

The cylinders 2 are of identical construction, so that the following further description relating to only one of the cylinders 2 should be considered as applying also to the other of the cylinders 2.

The cylinder 2 has a working space 6 provided with a connection port or union 7, which is connected through the intermediary of a pressure line 8 to a changeover or two-way valve 9. The changeover valve 9 has a working line 11 for a forward or positive stroke (lifting the protective cover 1) and a working line 12 for a return stroke (lowering the protective cover 1). Connected initially in the working line 11, as viewed from the switching member 9 in a direction towards the compressed-air source 4, is a non-return or check valve 10 followed by an adjustable or settable pressure-reducing valve 13. The pressure-reducing valve 13 has a setting or adjustment range S13 which corresponds to a pressure range P13=4.5 to 4.8 bar, approximately, for example.

Provided downstream of the pressure-reducing valve 13 is a 4/2-way valve 17 with an exhaust port 18, the 4/2-way valve 17 being electromagnetically switchable against the opposition of a return spring 16.

Disposed between the 4/2-way valve 17 and the compressed-air source 4 (the system pressure p4 for the compressed-air source 4 being, for example, approximately 6 bar) is a 3/2-way valve 21 with an exhaust port 22, the 3/2-way valve 21 being electromagnetically switchable against the opposition of a return spring 19.

The 4/2-way valve 17 has a connection port for the working line 12, that connection port being connected in parallel with the working line 11.

Connected initially into the working line 12 (as viewed from the changeover or two-way valve 9) is a non-return or check valve 20 followed thereafter by a settable or adjustable pressure-reducing valve 23 having a setting or adjusting range E23 corresponding to the pressure range P23=2.5 to 2.8 bar, approximately, for example. Disposed in parallel with the working line 12 is a further working line 24, which is connected at a line connection 26 to the working line 12.

A settable pressure-limiting valve 28 is built into the working line 24. The line connection 26 is connected through the intermediary of the working line 12 to the changeover or two-way valve 9.

A line connection 25 provided between the changeover or two-way valve 9 and the non-return or check valve 10 serves as a union or connector for a working line 29, into which there is built a two-pressure or double-pressure valve 30. From the double-pressure valve 30, the working line 29 leads to a line connection 33, which is disposed in the working line 12 between the pressure-reducing valve 23 and the 4/2-way valve 17. The double-pressure valve 30 is provided with a throttle 36, which is disposed between an exhaust port 34 and the double-pressure valve 30.

In order to bring the protective cover 1 from the lower "closed position" into the upper "open position", as viewed in the figure of the drawing, the working chamber 6 of the cylinder 2 is subjected to a pressure medium, preferably compressed air, and the piston 31 with the piston rod 32, which is attached to the protective cover 1, is extended so that the protective cover 1 is lifted.

For this purpose, the compressed-air source 4 delivers a working pressure p4 of, for example, approx. 6 bar, which is supplied through the intermediary of a first through position of the 3/2-way valve 21 and a first through position of the 4/2-way valve 17 to the pressure-reducing valve 13, by which it is reduced in the setting range E13 to P13=4.5 to 4.8 bar. Therefrom, the compressed air p13 reaches the non-return or check valve 10, through the intermediary of which it arrives at the changeover valve 9 and the working chamber 6 of the cylinder 2. The working pressure P13=4.5 to 4.8 bar is just enough to overcome the force of gravity of the protective cover 1 and to lift the protective cover 1. If the force of gravity of the protective cover 1 is augmented by a further force, e.g., by holding or blocking the protective cover 1, as may occur if operating personnel are present in the positioning region of the protective cover 1, the protective cover 1 remains in place.

In order to bring the protective cover 1 from the upper "open position" into the lower "closed position", as viewed in the figure, the 3/2-way valve 21 is initially switched and the 4/2-way valve 17 is switched into a second through position, so that the pressure-limiting valve 23 in the working line 12 is supplied with the working pressure P4=6 bar from the pressure source 4. At the same time, the double-pressure valve 30 is switched, so that the working line 11 is rendered pressureless in the region between the non-return or check valve 10 and the working chamber 6 through the intermediary of the exhaust port 34. Due to the switching of the 4/2-way valve 17, the working line 11 is rendered pressureless in the region between the non-return or check valve 10 and the 4/2-way valve 17 through the intermediary of the exhaust port 18. The changeover valve 9 is switched by the working pressure P23=2.5 to 2.8 bar, for example, the working pressure P23 being present in the working line 12 and being reduced by the pressure-limiting valve 23.

The working pressure P23 is such that it exerts less force than the force of gravity required for holding the protective cover 1, so that the protective cover 1 is lowered. In this case, the volume of the working chamber 6, which is compressed through the intermediary of the piston rod 32 and the piston 31, and a pressure increase resulting therefrom are reduced through the intermediary of the settable pressure-relief valve 28, so that a uniform counter-pressure is maintained throughout the entire lowering or descending movement of the protective cover 1. The setting range E28 of the pressure-relief valve 28 is identical with that of the pressure-limiting valve 23.

In the event of a sudden drop in pressure, e.g., through failure of the pressure source 4, the non-return or check valve 10 in the working line 11 and the non-return or check valve 20 in the working line 12 prevent the collapse of the respective working pressures P13 and P23 in the working chamber 6, during the lifting and the lowering, respectively, of the protective cover 1.

I claim:

1. An apparatus for opening and closing a protective cover on a printing press, comprising:

an actuator cylinder for moving a protective cover into respective opened and closed positions;

a control circuit for setting different working-pressure ranges of a pressure medium received by and actuating said actuator cylinder, the working pressure causing said actuator cylinder to move the protective cover from the closed position to the opened position and vise verse;

said control circuit determining and setting a working pressure of said actuator cylinder for lifting the protective cover so that it exceeds a force of a weight of the protective cover to an extent that it is at most equal to a determinable maximum shear force; and said control circuit determining and setting the working pressure of said actuator cylinder for lowering the protective cover so that it is less than the force of the weight of the protective cover to an extent that only the maximum determined shear force is effective.

2. The apparatus according to claim 1, wherein said actuator cylinder is of a single-acting construction.

3. The apparatus according to claim 2, wherein said control circuit includes a working line for lifting the protective cover into the opened position thereof, and a working line for lowering the protective cover into the closed position thereof, and wherein the working-pressure range in said working line for lifting the protective cover is set at a higher range than the working-pressure range in said working line for lowering the protective cover.

4. The apparatus according to claim 1, including a pressure-reducing valve built into said working line for lifting the protective cover.

5. The arrangement according to claim 1, including a pressure-reducing valve and a parallel-connected pressure-limiting valve built into said working line for lowering the protective cover.

6. The apparatus according to claim 3, including an additional working line having a double-pressure valve connected therein, said additional working line connecting said working line for lifting the protective cover to said working line for lowering the protective cover.

* * * * *